United States Patent [19]

Rogers, Jr.

[11] Patent Number: 4,570,996

[45] Date of Patent: Feb. 18, 1986

[54] FOOTREST ASSEMBLY FOR RECLINER CHAIRS

[75] Inventor: Walter C. Rogers, Jr., Denton, N.C.

[73] Assignee: Parma Corporation, Denton, N.C.

[21] Appl. No.: 478,228

[22] Filed: Mar. 24, 1983

[51] Int. Cl.[4] ..... A47C 1/035

[52] U.S. Cl. ..... 297/85; 297/68

[58] Field of Search ..... 297/85, 68, 84, 83, 297/89, 91, 217, 219, 429; 5/13

[56] References Cited

U.S. PATENT DOCUMENTS

| | | | |
|---|---|---|---|
| 283,111 | 8/1883 | Isberg | 297/429 |
| 2,922,464 | 1/1960 | Belisle | 297/84 |
| 2,929,440 | 3/1960 | Schliephacke | 297/84 |
| 2,948,331 | 8/1960 | Schliephacke | 297/84 |
| 3,010,761 | 11/1961 | Teague, Jr. | 297/84 |
| 3,047,336 | 7/1962 | Schliephacke | 297/85 |
| 3,128,122 | 4/1964 | Mizelle . | |
| 3,300,243 | 1/1967 | Mizelle . | |
| 3,429,612 | 2/1969 | Cobb | 297/429 |
| 3,494,660 | 2/1970 | Caldemeyer . | |
| 3,572,820 | 3/1971 | Ferguson | 297/84 |
| 3,781,060 | 12/1973 | Pentzien | 297/85 |
| 3,880,462 | 4/1975 | Mednick | 297/84 |
| 4,113,305 | 9/1978 | Hampton . | |
| 4,190,282 | 2/1980 | Crawford | 297/68 |
| 4,236,754 | 12/1980 | Ehlers | 297/423 |

FOREIGN PATENT DOCUMENTS

| | | | |
|---|---|---|---|
| 1208630 | 2/1960 | France | 297/84 |

*Primary Examiner*—William E. Lyddane
*Assistant Examiner*—Mark W. Binder
*Attorney, Agent, or Firm*—William E. Mouzavires

[57] ABSTRACT

A footrest assembly for a reclining chair wherein the support members of the footrest are substantially concealed from a view even when in the extended position projected forwardly from the front of the chair. The assembly includes a flexible cover of sheet-like material attached between the footrest and the seat frame while also being attached to the footrest support members to cover the same. In the preferred embodiment of the invention, the footrest support members are formed by an extendable and retractable linkage system whose links are arranged in a novel manner to allow the cover to be attached thereto in tailored fashion.

32 Claims, 8 Drawing Figures

FOOTREST ASSEMBLY FOR RECLINER CHAIRS

BACKGROUND OF INVENTION

The great majority of recliner chairs manufactured today utilize a footrest or ottoman that is mounted on a linkage mechanism which moves between a retracted, folded position below the front portion of the chair and an extended position projected forwardly from the front of the chair. The extended position of the linkage is, of course, used to place the footrest in position for receiving the feet and/or legs of the occupant of the chair as he sits in TV position or an advanced reclining position.

It is highly conventional in the recliner chair industry for footrest linkages to be made from a series of steel links pivoted together in an articulated fashion so as to be operable, for example, in the manner of a lazy-tong or pantograph linkage. Moreover, the footrest proper or ottoman is typically supported by two footrest linkage systems each connected to the footrest at one end and mounted to the chair frame at the other end. When the footrest is in the extended position, both footrest linkages are usually exposed along their intermediate portions. This exposure can present a potential hazard particularly to children or domestic pets should their extremities become caught between the links as the links fold towards closed or retracted position. Additionally, if the edges of the links are exposed, accidental striking against the exposed edges may cause injury to persons particularly in cases where, for example, the manufacturer has inadvertently failed to smooth or roll the edges of the metallic links during the manufacturing process.

Conventional footrest linkages have also suffered over the years from being unsightly. Thus, while considerable advancements have been made over the years in the overall styling of recliner chairs as well as in the arrangement and operation of the linkage systems thereof, virtually no improvement has been made to the footrest linkage from the standpoint of safety and appearance. While various flexible covers have been attached between the footrest and the chair frame to cover the space therebetween when the footrest is extended, these covers, by necessity, do not extend laterally sufficiently to conceal the footrest linkage for otherwise, they would interfere with the operation of the linkage system. The result is that today the footrest linkages or recliner chairs still stand as an eyesore in contrast to the advanced chair styling which surrounds the same.

OBJECTS OF THE PRESENT INVENTION

It is therefore an object of the present invention to provide, for recliner chairs, a new and improved footrest assembly which will enhance the appearance of the chair and yet will be safe and effective. Additionally, it is an object to provide a recliner chair incorporating the aforementioned footrest assembly.

A further object of the present invention is to provide such a footrest assembly whose supporting members may be substantially concealed from view when the footrest is in extended position projected forwardly from the associated chair. Included herein is such a footrest assembly whose supporting members may be covered by material to match the chair upholstery material or with any other suitable material of pleasing appearance.

Another important object of the present invention is to provide a footrest assembly including a linkage for mounting and supporting a footrest between extended and retracted positions in a reclining chair, which linkage is safe and effective while also capable of being provided in an attractive design that will not detract from the appearance of the chair. Included herein is such a footrest linkage which presents virtually no sharp edges or other parts when in the extended position so as to minimize the potential for injury to persons nearby or using the chair. Further included herein is such a footrest linkage whose internal linkage parts may be substantially concealed from view even when in the extended position.

A further object of the present invention is to provide such a footrest linkage as described above and which may be incorporated in virtually any type of new or existing recliner chair to be actuated by a handle or a "gravity" mechanism or by any other actuating method or system of the prior art.

Another object of the present invention is to provide a recliner chair incorporating the aforementioned footrest assembly including the linkage thereof.

SUMMARY OF INVENTION

In summary, the footrest assembly of the present invention includes a footrest (also termed "ottoman"), and extendable and retractable support members for mounting the footrest to the frame of an associated chair, preferably a reclining chair. The support members are provided in identical or substantially identical pairs spaced laterally from each other to operate in unison in extending and retracting the footrest. A cover of flexible sheet-like material is attached to and between the footrest and the frame of the associated chair. The cover also spans the space between, and is attached to, portions of the support members to conceal the same in the extended position of the footrest.

In the preferred embodiment, the footrest support members are formed by linkage systems whose links are arranged in novel manner to allow the cover to be attached thereto in a tailored fashion to conceal the links while also, at the same time, avoiding interference with the operation of the linkages during movement between extended and retracted positions of the footrest. In the retracted position of the footrest, the cover is folded. To control the folding of the cover when the footrest is moved to retracted position, the cover may be formed, at least in part, from a suitable structural material. If desired, the cover may also be formed from upholstery material to match that of the footrest and remaining portions of the associated chair. Other features and advantages of the present invention are described below.

DRAWINGS

Other objects and advantages of the present invention will be apparent from the following more detailed description taken in conjunction with the attached drawings in which.

DETAILED DESCRIPTION

Figure 1:
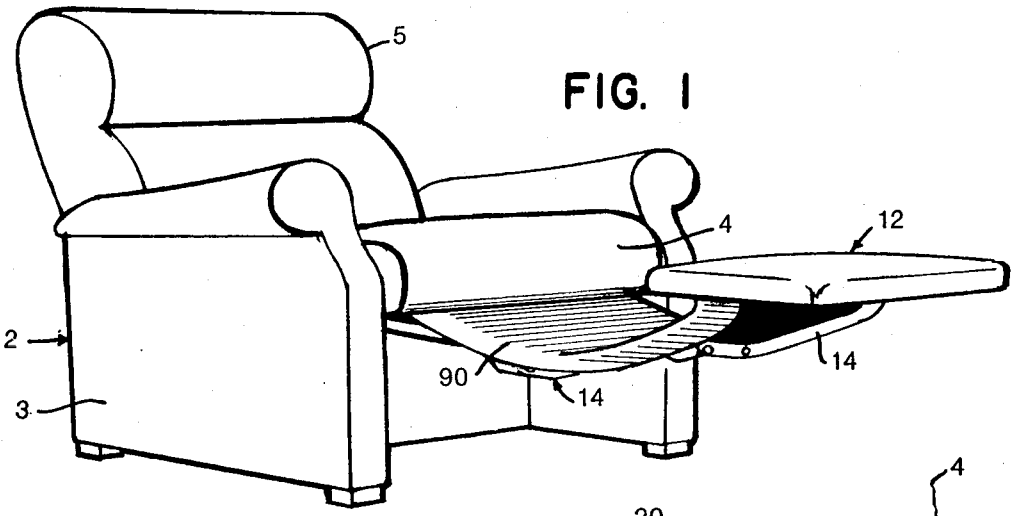
FIG. 1 is a perspective view of a recliner chair embodying the footrest assembly of the present invention, the latter being shown in the extended position thereof.

Referring now to FIG. 1, there is shown for illustrative purposes only, a recliner chair generally designated 2 incorporating a preferred embodiment of the footrest assembly, generally designated 12, of the present invention; the footrest assembly being shown in the extended position where it is projected forwardly from the chair. Apart from the footrest assembly of the present invention, the recliner chair may be of any suitable type, such as a "two-way" or a "three-way" reclining chair and even a rocking reclining chair or a rocking and/or swiveling recliner chair (both not shown). In the specific embodiment shown, the chair 2 is a two-way reclining chair whose armrests 3 are stationary and form the basic support for the chair. The seat and backrests generally designatd 4 and 5 respectively are fixed relative to each other to move as a unit relative to the armrests 3 when the chair occupant pushes off the armrests 3 and exerts pressure on the backrest 5. The seat and backrest unit 4, 5 are mounted, of course, to the armrest 3 in a manner to be described below.

Figure 2:
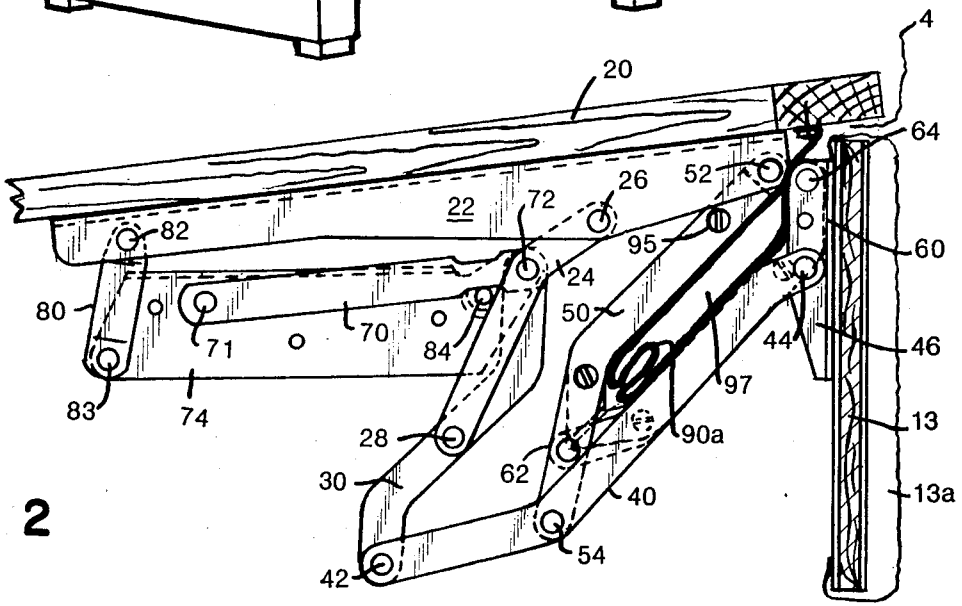
FIG. 2 is a cross-sectional view of the chair of FIG. 1 as seen from the inside looking out and with portions removed and illustrating the footrest assembly in closed position.

FIG. 1 also illustrates a cover generally designated 90 in accordance with the invention, for support members generally designated 14 which mount and support the footrest 12 relative to the chair for movement between the extended position shown in FIG. 1 and a retracted position where the footrest 12 extends downwardly generally in a vertical plane below seat 4 as best shown in FIG. 2. In the preferred form of the invention shown and to be described below, footrest mounting members 14 take the form of novel linkage systems which are identical and spaced laterally from each other with one of their ends mounted to the chair frame which, in the specific embodiment, are the armrests 3, and with the other of their ends mounted to the footrest 12 as will be described in greater detail. Inasmuch as the footrest linkage systems shown are identical, only one system will be described below.

Figure 5:
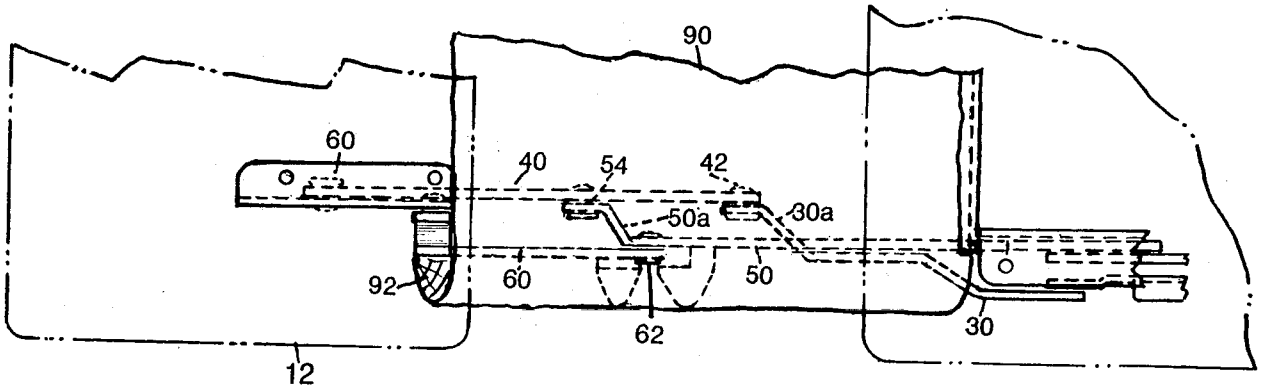
FIG. 5 is a plan view of the chair shown in FIG. 1, however, with certain parts removed.
Figure 8:
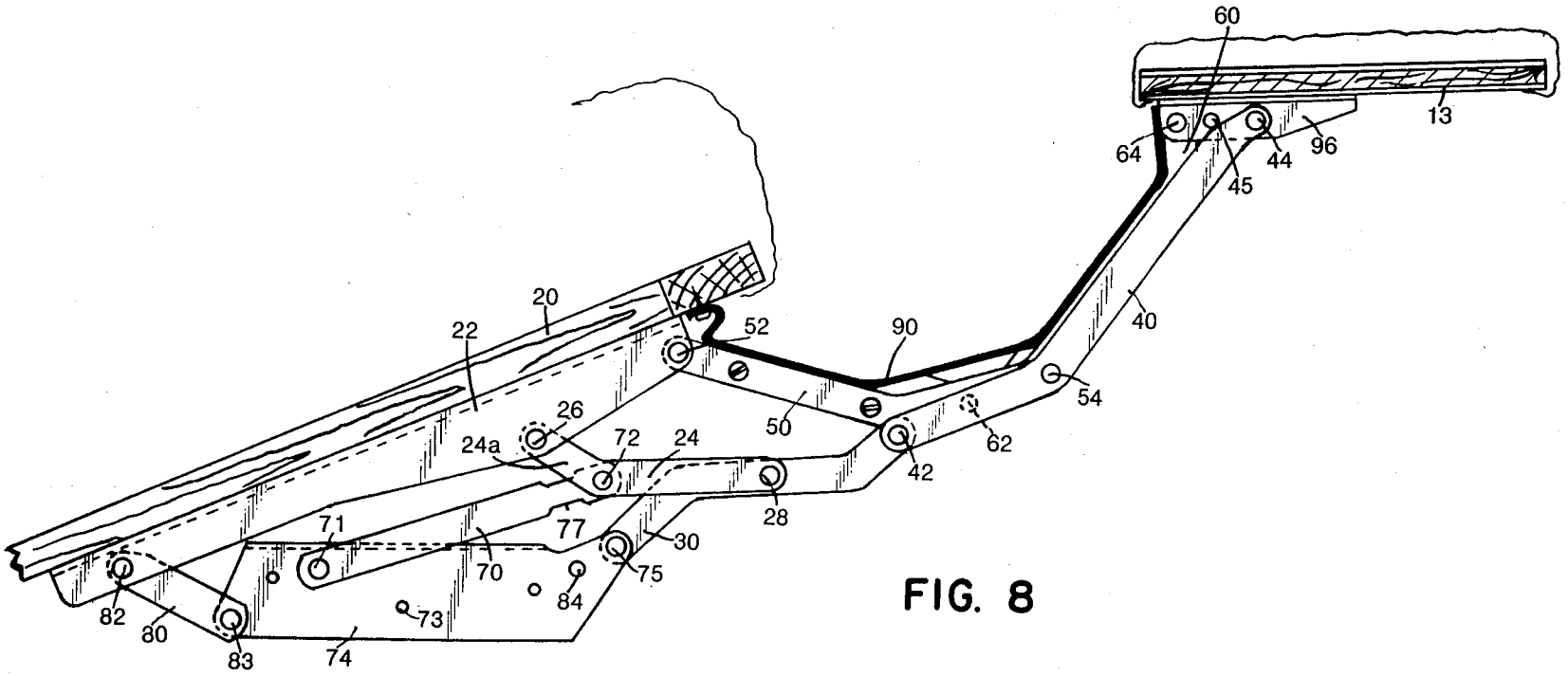
FIG. 8 is a view similar to FIG. 3 except showing the parts when the chair has been moved to an advanced reclining position beyond TV position.

Referring now to FIGS. 2, 5 and 8, the footrest linkage system of the preferred embodiment includes four basic links, namely 30, 40, 50 and 60. Links 30 and 50 may be termed "mounting links" because they are mounted at pivots 75 and 52 respectively relative to the chair. In the specific embodiment shown, link 50 is mounted by pivot 52 relative to the seat frame 20 by means of a seat link 22 which is elongated and extends below the seat frame 20 and is fixed thereto by screws or rivets or any other suitable fasteners so as to act as a mounting bracket for various links as will be described. The other mounting link 30 is pivoted by pin 75 to a fixed link 74 in the form of a plate-like member which is fixed to armrest 3 to be stationary and provide a mounting bracket for various links as will be further described. FIG. 8 shows apertures 73 in the fixed link 74 for receiving fasteners which secure link 74 to the armrest frame, the latter not being shown in FIG. 8 but which may be comprised of any suitable conventional elements.

The remaining basic links 40 and 60 of the footrest assembly are pivoted at pivots 44 and 64 respectively relative to the footrest 12. In the specific embodiment shown, the footrest 12 includes an internal frame 13 made of any suitable material such as wood covered by suitable upholstery 13*a*. Additionally, a bracket link 46 is fixed to the backside of footrest frame 13 to act as a mounting bracket receiving the pivots 44 and 64 which serve to pivotally mount the links 40 and 60 to the footrest 12. As clearly shown in the drawings, pivots 44 and 64 are spaced from each other along a line which extends generally parallel to footrest frame 13. Additionally, as shown in FIG. 8, a stop 45 is fixed to bracket link 46 to engage the upper edge of the link 40 to define the fully extended position of footrest 12 relative to links 40 and 60.

Figure 3:
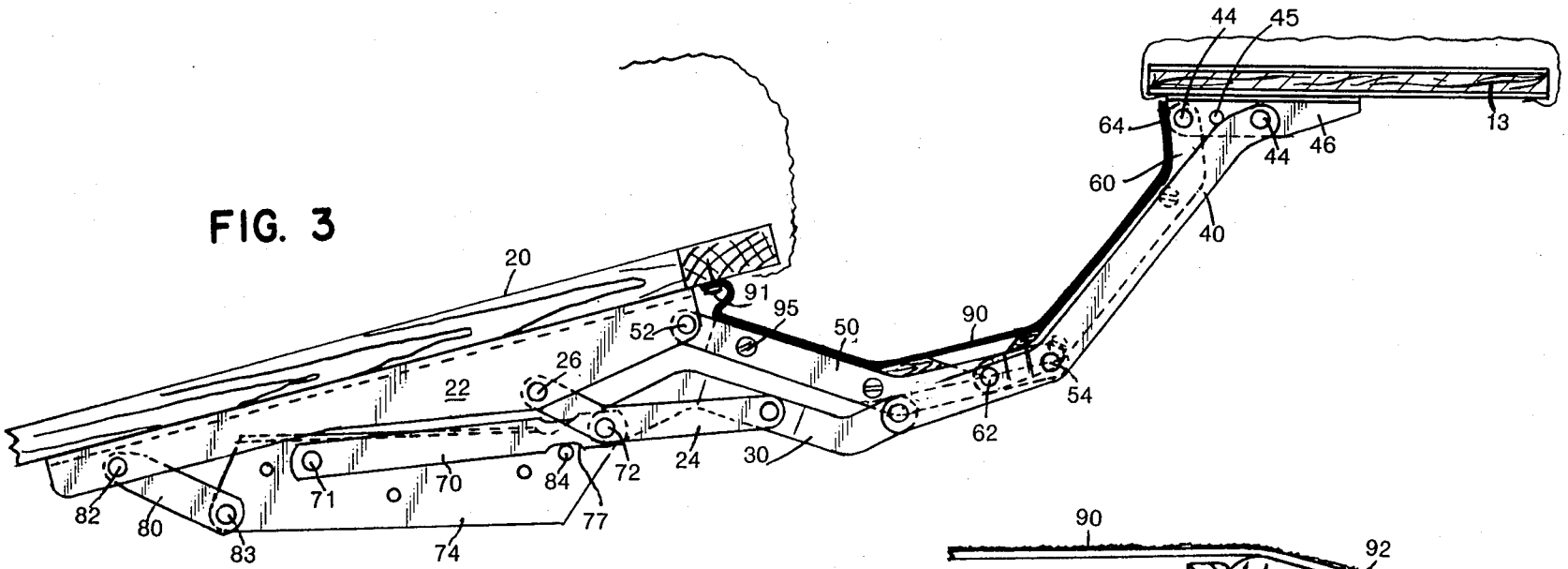
FIG. 3 is a view similar to FIG. 2 except that the footrest assembly is shown in an extended position when the associated chair is in the TV position.

As clearly seen in FIGS. 2 and 8, links 30 and 40 are pivotally interconnected at their end portions by pivot 42. As perhaps best shown in FIG. 5, links 50 and 60 are also pivotally interconnected by pivot 62. It will be noted from FIG. 5 that pivot 62 is located at the end portion of link 60 and at an intermediate portion of link 50. Additionally, link 50 at its one end, nearest pivot 62, is pivotally connected by pivot 54 to an intermediate portion of link 40 as perhaps best shown in FIG. 3. The latter is achieved through the provision of an offset portion 50*a* which is offset inwardly from the major plane of link 50 as best shown in FIG. 5. It will also be noted that link 30 is offset at 30*a* in order to connect it at pivot 42 to the rear end of link 40.

Figure 4:
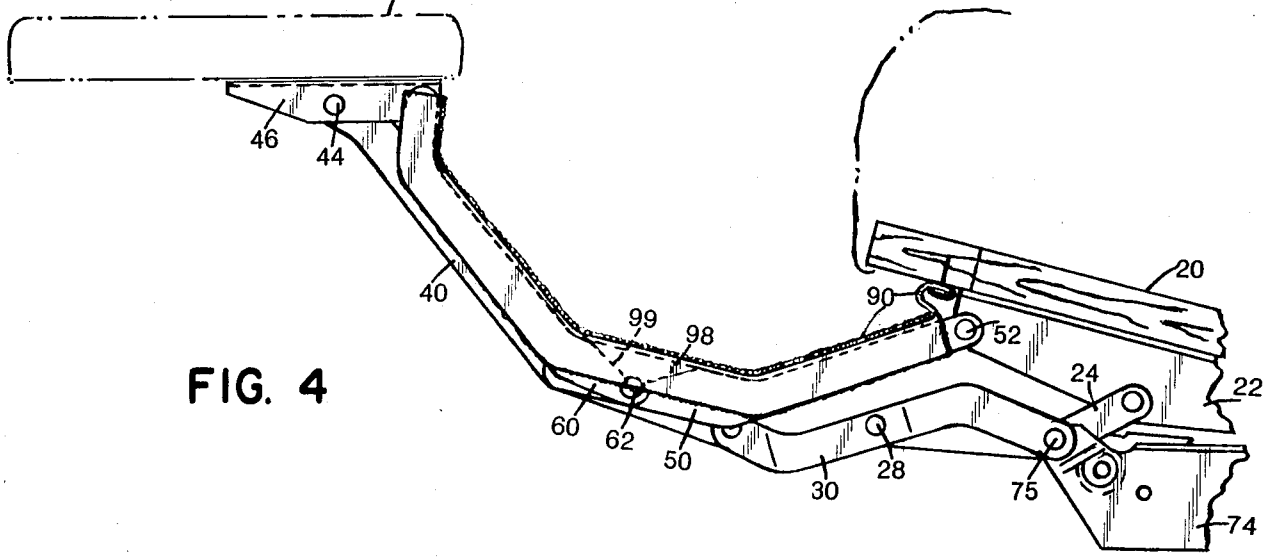
FIG. 4 is a view similar to FIG. 3 but showing the parts as seen from the opposite sides thereof and with certain parts broken away.

In the TV position of the chair wherein the footrest 12 is extended as shown in FIG. 4, links 50 and 60 form an extension of one another (see FIG. 5). Additionally, link 40 is positioned substantially behind link 60 to be substantially concealed thereby, while link 50 is positioned above link 30. Furthermore, links 30, 40, 50 and 60 extend in parallel planes with the exception, of course, of the offset portions 50*a*, 30*a*, etc. of links 50 and 30. As the shapes of the links 30, 40, 50 and 60 are clearly disclosed in the drawings, they need not be described here.

Referring now to FIG. 8, the seat in the specific embodiment shown is mounted to the armrests 3 by means of a linkage including seat link 22, upper portion 24*a* of link 24, link 70 and link 80. Link 24 which also functions as a draw bar or actuator as will be described is pivoted at its upper end by pivot 26 to seat link 22, and at its lower end by pivot 28 to an intermediate portion of footrest link 30. An intermediate portion of link 24 is pivotally connected by pivot 72 to link 70 which, in turn, is pivotally mounted by pivot 71 to fixed link 74. Link 80 is pivotally mounted at its lower end by pivot 83, to fixed link 74, while its upper end is pivotally connected by pivot 82 to a rear portion of seat link 22. When the chair is in the closed or TV positions shown respectively in FIGS. 2 and 3, pivots 72 and 75 (shown in FIG. 8) are located in side-by-side concentric relationship. In the specific embodiment, this is achieved by means of a stop pin 84 which receives the lower edge of link 70 at the recess 77 thereof to thereby determine the position of link 70 when the chair is in the closed or TV positions. When the chair is moved to an advanced reclining position, such as shown in FIG. 8, beyond the TV position of FIG. 3, as will be described in greater detail, pivot 72 moves above pivot 75 out of the aforementioned concentric relationship. As shown in FIG. 2, stop 84 also determines the closed position of the footrest linkage by virtue of engagement with the rear edge of link 24.

The operation of the chair and its linkage system will now be reviewed. FIG. 2 shows the linkage system in the closed position occupied when the chair is in the normal generally upright position with the footrest, of course, closed. In order to place the chair into TV position, the chair occupant merely pushes off the armrests 3 while exerting pressure on backrest 5. This will cause the seat 20 to move and swing rearwardly relative to armrests 3 thereby causing link 24 to pivot about pivot 26 in a counterclockwise direction as viewed in FIGS. 2 and 3. Link 24 will therefore drive footrest mounting link 30 from the position shown in FIG. 2 to the position shown in FIG. 3. Such actuation of link 30 will, of course, extend the entire footrest linkage into the position shown in FIG. 3. During such movement, link 70 will remain engaged on stop 84 and pivot 72 will remain in position concentric with pivot 75 of link 30. Also, during such movement, the footrest 12 will pivot relative to links 40 and 60 until it reaches the position shown in FIG. 3 determined by engagement of stop 45 with the rear edge of link 40.

Should it now be desired to move to an advanced reclining position beyond TV position, the chair occupant merely has to push off further on the armrests 3 while exerting back pressure on the backrest 5. This will cause link 70 to pivot counterclockwise as viewed in FIGS. 3 and 8 about pivot 71 relative to the armrest which will cause link 24 to move upwardly as set 20 is swung rearwardly into a greater inclined position. Link 24 will thus act to pivot footrest mounting link 30 counterclockwise about pivot 75 causing the footrest 12 to move from the TV position shown in FIG. 3 to the position shown in FIG. 8 which position is compatible with the advanced reclining position of the seat 4, 20. During the abovedescribed movement from closed to TV to advanced reclining position, the backrest 5 will, of course, move with the seat as a unit since the backrest and seat are rigidly fixed to each other as a unitary structure. In order to return the chair to closed position, the occupant first leans forward to restore the chair to TV position and then the occupant need only exert leg pressure on the footrest 12 to fold the footrest linkage until the footrest 12 reaches the closed position of FIG. 2 which will be positively determined by engagement of stop 84 with the rear edge of link 24.

Figure 7:
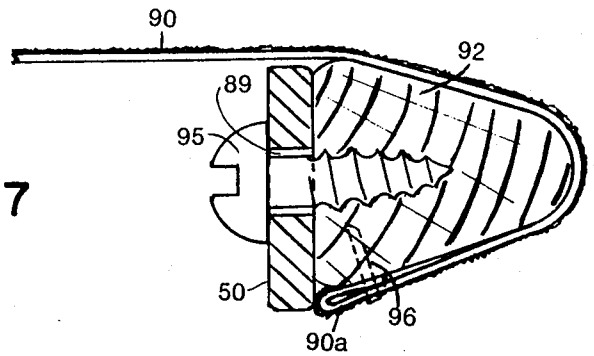
FIG. 7 is a cross-sectional view taken generally along lines 7—7 of FIG. 6.
Figure 6:
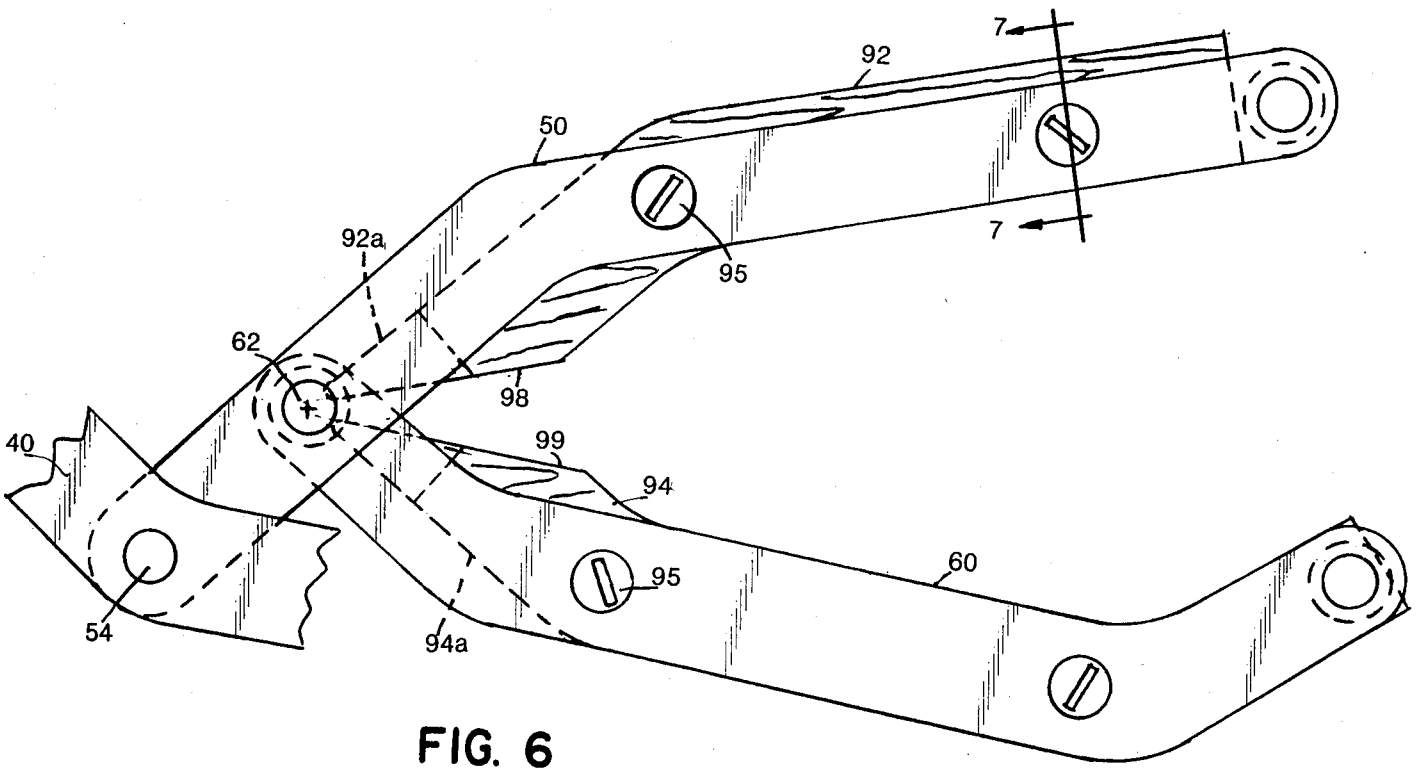
FIG. 6 is an enlarged side view of a portion of the linkage system included in the footrest assembly of the present invention.

The unique footrest linkage shown and described allows the cover 90 to be applied thereto in accordance with the present invention so as to substantially conceal the footrest linkage. The opposite ends of the cover 90 are attached such as by tacking to the footrest frame 13 and the seat frame 20. Additionally, and in accordance with the present invention, the cover 90 is attached along its opposite side margins to footrest links 50 and 60 so as to cover the same as shown in FIGS. 1 and 4. In the preferred embodiment, means are fixed to the outer sides of links 50 and 60 to receive and fix the margins of cover 90 thereto. In the specific embodiment shown, elongated blocks or molding strips of wood 92, 94 are fixed to the outer sides of links 50 and 60 by means of fasteners 95 inserted through apertures 89 and into the strips 92, 94 as shown in FIG. 7. As is also shown in FIG. 7, the cross section of strips 92, 94 in the specific embodiment is generally V-shaped, however, other shapes may, of course, be utilized if desired. Additionally, other materials such as foam or plastic may be utilized in making the strips 92, 94. As shown in FIG. 7, the marginal sides of cover 90 are placed on and about the surface of strips 92, 94 and secured to their underside in any suitable manner such as by tacks 96 (one shown in FIG. 7). In the specific footrest linkage shown, it is preferred that the marginal side edges of the strips 92, 94 at the juncture of pivot 62 pass through or substantially through the axis of pivot 62 as shown in FIGS. 4 and 6. In this way, the side edges of the cover 90, when the footrest is extended (see FIG. 4), will also pass through the pivot 62 and thus will not stretch when the footrest linkage is folded closed. Referring to FIG. 6, it will therefore be seen that the planes of the marginal surfaces at 92*a* and 94*a* of strips 92 and 94 intersect at the pivot 62. In the embodiment where the strips 92, 94 project beyond the edges of their associated links 50 and 60 at the juncture of pivot 62, the strips may be mitered such as shown at 98 and 99 in FIG. 6 to allow the links 50, 60 to fold into their fully closed position as shown in FIG. 2.

The configuration and geometry of the footrest linkage is also such as to provide a cavity 97 between the link pair 40, 60 and link 50 when the footrest linkage is in the closed or folded position of FIG. 2. Cavity 97 accommodates cover 90 and particularly the intermediate or transitional section 90*a* which is not attached to the strips 92, 94 but rather is free to fold into the cavity as shown in FIG. 2. Cover 90 may be formed from any suitable sheetlike, flexible material which may correspond to be identified to the upholstery material of the footrest 12, and the remainder of the chair parts, 3, 4 and 5. Cover 90 may also be made from a structural material such as woven polypropylene or a combination of conventional upholstery material and structural material. This would, of course, increase the strength of the cover 90 which would aid the capability of the cover 90 to minimize side sway of the footrest linkages, which capability is another advantage made possible by attaching the cover 90 to the footrest linkages. To increase the strength of the cover material in cases where it is a woven material, the material could be bias cut so that the warp and fill strands or threads would extend at an angle to the transverse or longitudinal direction of the cover 90. Use of the aforementioned structural material could also be made at the intermediate or transitional section 90*a* (see FIG. 2) of the cover in order to control the folding at that section so that it would fold as desired into cavity 97 as shown in FIG. 2.

As will be apparent from FIGS. 1 and 4, the footrest assembly of the present invention in the extended position possesses a highly attractive profile with minimum linkage exposure in contrast to that of conventional footrest assemblies which utilize exposed pantograph or lazy-tong linkage systems. Additionally, the footrest linkage of the present invention eliminates or minimizes exposed spaces between links as well as link edges that would otherwise present a hazardous condition. In covering the entire area between the footrest linkages on opposite sides of the chair, the cover 90 of the present invention provides an extremely attractive as well as safe surface while also serving to minimize side sway between said linkages.

Although the specific two-way recliner chair and seat mounting linkage has been illustrated and described, it should be understood that other types of two-way or three-way recliner chairs and seat linkage systems (not shown) may be employed in conjunction with the footrest linkage of the present invention. In such other chairs, the footrest linkage may be actuated through a handle typically mounted to one side of the chair such as disclosed in my U.S. Pat. Nos. 4,226,469 or 4,108,491 or it may be actuated by a gravity mechanism such as shown in my U.S. Pat. No. 4,350,387. Additionally, the footrest linkage may be actuated through the armrests such a shown in my U.S. Pat. Nos. 4,185,869 and 4,249,772 or by another suitable means. In all such cases, links 70 and 24 would have to be either modified or replaced by other appropriate actuator links or mechanisms suited to the particular chair involved. It therefore should be apparent that the footrest assembly of the present invention should not be limited to the specific chair and actuating system shown and described herein. Moreover, other modifications and variations of the present invention will no doubt become readily apparent to those skilled in the art but without departure from the scope of the present invention which is indicated in the appended claims.

What is claimed is:

1. In a reclining chair including a seat, the improvement comprising a footrest assembly including in combination, a footrest, a pair of laterally spaced support members mounting the footrest to the chair for movement between a retracted position generally below the seat and an extended position projected forwardly of the seat, and a cover fixed at its opposite ends to the chair and the footrest and at its opposite sides to the support members to be movable with the footrest between the retracted and extended positions, and wherein said cover has opposite side portions covering and directly attached to said support members and has intermediate portions extending over and covering the space between said support members when the footrest is in the extended position.

2. In a chair including a seat, the improvement comprising a footrest assembly including in combination, a footrest, a pair of laterally spaced support members mounting the footrest to the chair for movement between a retracted position generally below the seat and an extended position projected forwardly of the seat, and a cover extending between said support members and having opposite side portions secured directly to the support members, said support members having means defining a cavity when the footrest is in said retracted position, and said cover having opposite side portions received in said cavity when the footrest is in said retracted position.

3. The chair defined in claim 2 wherein said cover is made from flexible sheet material having opposite side edges secured to and along said support members.

4. The chair defined in claim 3 wherein said support members each include a pair of links pivotally interconnected at a pivot axis, said links defining said cavity, and said side portions of the cover are free of any attachment to said links at said pivot axis.

5. The chair defined in claim 4 wherein said cover has a foldable portion located adjacent said pivot axis.

6. The chair defined in claim 5 wherein said opposite side portions of said cover are secured to said support members along lines which generally intersect said pivot axis.

7. The chair defined in claim 6 wherein said opposite side portions of the cover extend beyond and cover said links in each pair of links.

8. The chair defined in claim 2 wherein said opposite side portions of the cover extend over and beyond said support members.

9. The chair defined in claim 2 wherein said support members each include a pair of links pivotally interconnected at a pivot axis, and said links defining said cavity, said cover having a foldable portion located adjacent said pivot axis.

10. The chair defined in claim 9 wherein said cover is made from flexible sheet material and said side portions of said cover extend over and about said links in each pair of links.

11. The chair defined in claim 2 wherein said support members each include a pair of links pivotally interconnected at a pivot axis, said links defining said cavity, and said side portions of the cover are secured to both links in each pair of links.

12. A footrest assembly for a recliner chair comprising in combination, a footrest, a pair of support and mounting members laterally spaced from each other and having first ends attached to the footrest and second opposite ends adapted to be mounted to an associated chair to support the footrest for extendable and retractable movement relative to the chair, and a cover extending between and attached to said members, and wherein each of said support and mounting members includes a linkage system movable between extended and retracted positions, said cover having a foldable portion movable into a folded position when the linkage systems are moved to retracted positions, and wherein each of said linkage systems includes a first pair of links pivotally connected to the footrest, a second pair of links pivotally connected to the first pair respectively and being adapted to be mounted to a associated chair, said cover being directly attached to respective pairs of said first and second pair of links.

13. The footrest assembly defined in claim 12 wherein said links in each of said first and second pairs of links include cover-receiving members fixed on outer sides thereof, said cover having opposite side edge portions extending over and covering said links while being attached to said cover-receiving members.

14. The footrest assembly defined in claim 12 wherein one of said links of said second pair of links is pivotally connected to both of said links of said first pair.

15. The footrest assembly defined in claim 12 wherein said cover is made from sheet-like material including woven polypropylene.

16. The footrest assembly defined in claim 12 wherein said cover is made from flexible, woven, bias-cut, sheet-like material.

17. The footrest assembly defined in claim 12 wherein said cover extends over and covers said links in each of said first and second pairs of links.

18. The footrest assembly defined in claim 12 including pivot means pivotally interconnecting said links to which said cover is attached and wherein side margins of said cover substantially intersect said pivot means.

19. The footrest assembly defined in claim 12 wherein said first pair of links and one of said second pairs of links form a cavity when the linkage system is in retracted position, and wherein said cover has a flexible intermediate portion foldable within said cavity.

20. A reclining chair comprising in combination, a seat, a support means, a footrest assembly including a footrest and a pair of laterally spaced linkage systems interconnected between said support means and said footrest for supporting said footrest between a retracted position generally below the seat and an extended position projected forwardly from the seat, and a cover extending between and directly attached to said linkage systems and extending substantially throughout the distance between said footrest and said seat when the footrest is in said extended position thereof, said cover including a foldable portion having a folded position under the seat and behind the footrest when the footrest is in the retracted position.

21. The chair defined in claim 20 wherein each of said linkage systems includes a first pair of links pivotally connected to the footrest, a second pair of links pivotally connected to the first pair respectively and being mounted to the chair, said cover being attached to links in each of said first and second pairs of links.

22. The chair defined in claim 21 wherein one of said links of said second pair of links is pivotally connected to both of said links of said first pair.

23. The chair defined in claim 22 including pivot means pivotally interconnecting said links to which said cover is attached and wherein side margins of said cover substantially intersect said pivot means.

24. The chair defined in claim 23 wherein said first pair of links and one of said second pair of links form a cavity when the linkage system is in a folded position, and wherein said cover has a flexible intermediate portion foldable within said cavity.

25. In a recliner chair, a footrest assembly including a footrest, linkage systems on opposite sides of the footrest for supporting the footrest, each linkage system including a first pair of links extending in generally side-by-side interrelationship and pivotally connected to the footrest, a second pair of links having portions extending in spaced vertical planes and having end portions pivotally mounted with respect to the chair for providing swinging movement of said second pair of links between retracted position located under the chair and extended positions projected forwardly from the chair, said first and second pairs of links being respectively pivotally connected to each other such that said first pair of links will extend generally forwardly from the second pair of links when the second pair are in said extended positions thereof, and means for swinging said second pair of links between said positions thereof, and wherein said first and second pairs of links are dimensioned and connected to each other such that when the second pair of links are in said retracted positions thereof, the first pair of links will extend below one link of said second pair of links to define therewith a cavity for receiving a cover to be attached to the links in said first and second pairs of links and wherein there is further included a cover extending between and directly attached to respective pairs of links in said linkage systems, said cover being foldable and having opposite side portions receivable in each cavity respectively when said second pair of links are in said retracted positions.

26. The recliner chair defined in claim 25 wherein said pairs of links include means on certain links for attaching a cover thereto.

27. The recliner chair defined in claim 26 wherein said means recited in claim 17 are strips of material fixed along outer surfaces of said certain links.

28. The recliner chair defined in claim 27 wherein one of said links in said second pair of links is pivotally connected to both of said links of said first pair.

29. The chair defined in claim 25 wherein one of said links in said second pair of links is pivotally connected to both of said links of said first pair.

30. For use in a reclining chair, a footrest linkage including a bracket link adapted to be fixed to a footrest, a first pair of links extending in generally side-by-side interrelationship and pivotally connected to the bracket link, a second pair of links having portions extending in spaced vertical planes generally parallel to those of said first pair of links and further having end portions adapted to be pivotally mounted with respect to an associated chair for providing swinging movement of said second pair of links between retracted positions located under the chair and extended positions projected forwardly from the chair, said first and second pairs orf links being respectively pivotally connected to each other such that said first pair of links will extend generally forwardly from the second pair of links when the second pair are in said extended positions thereof, and wherein said first and second pairs of links are dimensioned and connected to each other such that when the second pair of links are in said retracted positions thereof, the first pair of links will extend below one link of said second pair of links to define therewith a cavity for receiving a cover to be attached to the links in said first and second pairs of links, and wherein said first pair of links includes one link positioned relative to the bracket link outwardly of the other link in said first pair, one of said links of said first and second pairs of links having an offset portion spacing links in said pairs of links from each other to define said cavity such that said cavity extends substantially throughout the length of said links for receiving a cover when said second pair of links are in retracted position.

31. The footrest linkage defined in claim 30 wherein said first pair of links includes one link positioned relative to the bracket link outwardly of the other link in said first pair, said one link being in a plane substantially parallel or coplanar with one link in said second pair, and wherein there is included means including strips of material on each of said one link of said pairs of links for attaching a footrest cover thereto.

32. The footrest linkage defined in claim 31 wherein said one link of each pair of links are pivotally interconnected at a pivot axis, and wherein said means includes portions positioned on lines which generally intersect said pivot axis.

* * * * *